US009828712B2

(12) United States Patent
Taylor et al.

(10) Patent No.: US 9,828,712 B2
(45) Date of Patent: Nov. 28, 2017

(54) EMBROIDERY FRAME FOR A CAP

(71) Applicant: Durkee Embroidery, Inc., Davidson, NC (US)

(72) Inventors: Claude Brent Taylor, Davidson, NC (US); Jefferey Neale Garrett, Sr., Destin, FL (US); Katherine M. Garrett, Destin, FL (US)

(73) Assignee: DURKEE EMBROIDERY, INC., Davidson, NC (US)

( * ) Notice: Subject to any disclaimer, the term of this patent is extended or adjusted under 35 U.S.C. 154(b) by 0 days.

(21) Appl. No.: 15/250,462

(22) Filed: Aug. 29, 2016

(65) Prior Publication Data

US 2017/0058444 A1 Mar. 2, 2017

Related U.S. Application Data

(60) Provisional application No. 62/211,755, filed on Aug. 29, 2015.

(51) Int. Cl.
*D05C 9/04* (2006.01)

(52) U.S. Cl.
CPC ..... *D05C 9/04* (2013.01)

(58) Field of Classification Search
CPC ... D05C 9/04; D05C 9/02; D05C 9/06; D05B 39/00; A42C 1/08
USPC ..... 112/103
See application file for complete search history.

(56) References Cited

U.S. PATENT DOCUMENTS 4,598,488 A * 7/1986 Inteso ..... D05C 9/04 112/103
4,665,844 A * 5/1987 Shibata ..... D05B 21/00 112/103
4,831,753 A * 5/1989 Inteso ..... D05C 9/04 112/103
5,598,797 A * 2/1997 Patterson ..... D05B 39/00 112/103
5,649,496 A * 7/1997 Morita ..... D05B 39/00 112/103
5,884,571 A * 3/1999 Valadez ..... D05C 9/04 112/103
5,887,534 A * 3/1999 French ..... D05C 9/04 112/103
5,915,315 A * 6/1999 Bentz ..... D05B 39/00 112/103
5,992,339 A * 11/1999 Mack ..... D05C 9/04 112/103
6,095,068 A * 8/2000 Hori ..... D05C 9/04 112/103
6,189,468 B1 * 2/2001 French ..... D05C 9/04 112/103
6,463,867 B2 * 10/2002 Kato ..... D05C 9/04 112/103

(Continued)

*Primary Examiner* — Danny Worrell
(74) *Attorney, Agent, or Firm* — Trego, Hines & Ladenheim, PLLC

(57) ABSTRACT

An embroidery frame for a garment that is configured to retain the garment in a repeatable position relative to an embroidery machine. The embroidery frame includes a base and the clamp plate. The clamp plate is spaced away from the base and is configured such that a garment can be retained between the clamp plate and the base. Markings are defined by the clamp plate such that the markings are in a predetermined location relative to the base.

17 Claims, 7 Drawing Sheets

(56) References Cited

U.S. PATENT DOCUMENTS

| | | | | |
|---|---|---|---|---|
| 6,775,934 | B1 * | 8/2004 | Gallik | D05C 9/04 112/103 |
| 7,080,602 | B2 * | 7/2006 | Kawaguchi | D05C 9/04 112/103 |
| 7,527,004 | B1 * | 5/2009 | White | D05B 39/00 112/103 |
| 7,624,693 | B2 * | 12/2009 | Fabec | D05C 1/02 112/103 |
| 7,980,177 | B2 * | 7/2011 | Styles | A42C 3/00 101/126 |
| 8,807,031 | B2 * | 8/2014 | Styles | B41J 3/4073 101/126 |
| 8,844,452 | B2 * | 9/2014 | Savoldi | D05B 21/007 112/103 |
| 9,265,298 | B2 * | 2/2016 | Viltrakis | A42C 1/06 |
| 2002/0038621 | A1 * | 4/2002 | Ozeki | D05C 9/04 112/103 |
| 2017/0058444 | A1 * | 3/2017 | Taylor | D05C 9/04 |

* cited by examiner

EMBROIDERY FRAME FOR A CAP

FIELD OF THE INVENTION

The invention relates generally to embroidery frames for embroidery machines configured to retain a garment in a fixed position relative to an embroidery machine and more specifically to an embroidery frame that is configured to position a hat or cap relative to an embroidery machine such that an embroidered design an be applied to the hat or cap in a predetermined location.

BACKGROUND OF THE INVENTION

Embroidery machines are configured to position a garment relative to a needle on the machine such that a predetermined pattern can be stitched by the needle onto the garment in a predetermined location. It is desirable to locate a pattern in the same relative place on successive garments. Conventionally, it is known to use hoops and frames for this purpose. Conventional frames are known for garments that have a generally two dimensional surface such as a shirt or towel. There are also conventional devices known for positioning garments have a surface to be embroidered that are generally three-dimensional such as has and caps. However, such devices have problems positioning to the hats and caps in predetermined locations precisely and repeatably.

Therefore there is a need for to device that is configured to retain a cap such that an area that is to have a design embroidered on it is positioned in a predetermined position relative to an embroidery machine.

SUMMARY OF THE INVENTION

The present device addresses this need by providing a frame that includes to retaining clip. The retaining clip, or bill clip, includes markings that are configured to identify how the cap is oriented along x and y axes relative to the retaining dip. The retaining clip is configured to be in a fixed position relative to the frame and the frame is configured to be mounted to an embroidery machine in a predetermined orientation. In this manner the hat or cap fixed in the frame can be placed in to repeatable position relative to the embroidery machine such that multiple caps can be embroidered in successive processes with substantially the same design in substantially the same position on each cap.

According to one aspect of the present invention there is provided an embroidery frame for a garment that is configured to retain the garment in a repeatable position relative to an embroidery machine. The embroidery frame includes a base and a clamp plate. The clamp plate is spaced-away from the base and is configured such that a garment can be retained between the first plate and the base. Markings are defined by the clamp plate such that the markings are in a predetermined location relative to the base.

According to another aspect of the present invention there is provided a method for positioning a garment in a predetermined location relative to an embroidery frame, the method includes the following steps: positioning a portion of the garment within a retaining clip; aligning a location on the garment with markings defined by the retaining clip; and capturing the garment in the retaining clip.

BRIEF DESCRIPTION OF THE DRAWINGS

For a fuller understanding of the nature and objects of the present invention, reference should be made to the following detailed description taken in connection with the accompanying photos, wherein.

DETAILED DESCRIPTION

Figure 1:
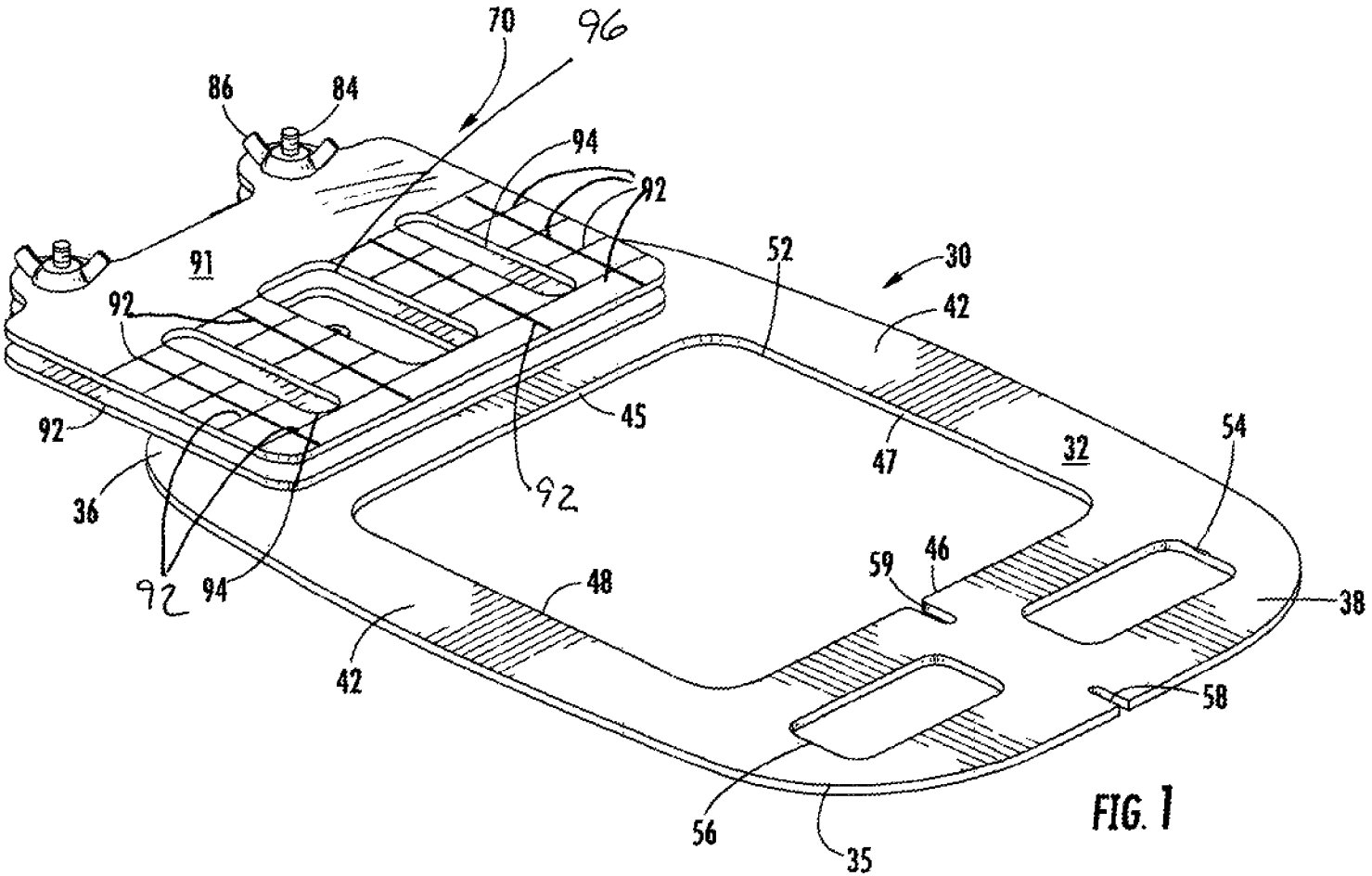
FIG. 1 shows a perspective view of an embroidery frame in accordance with the present invention.
Figure 2:
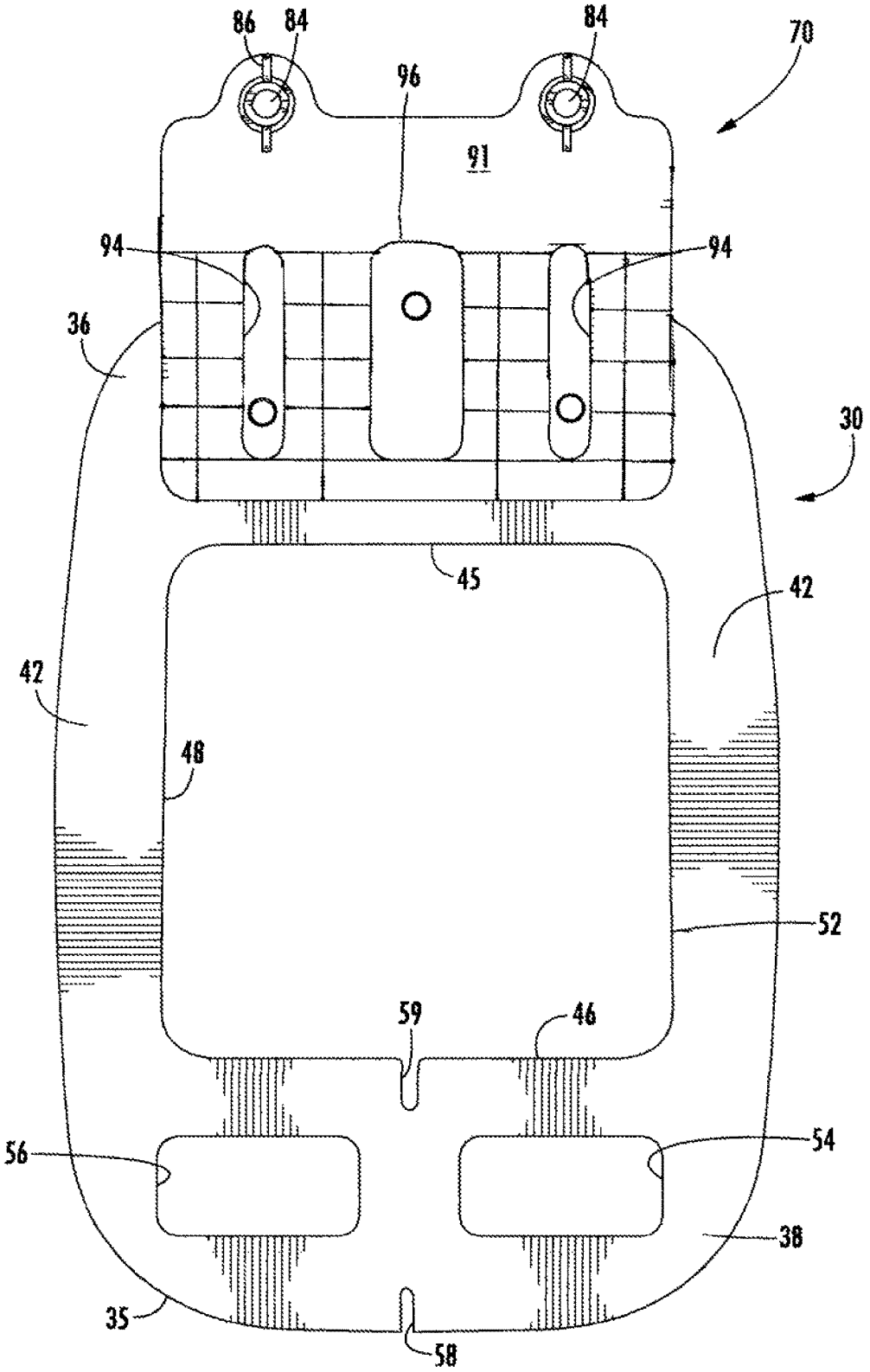
FIG. 2 shows a top plan view of the embroidery frame shown in FIG. 1.
Figure 4:
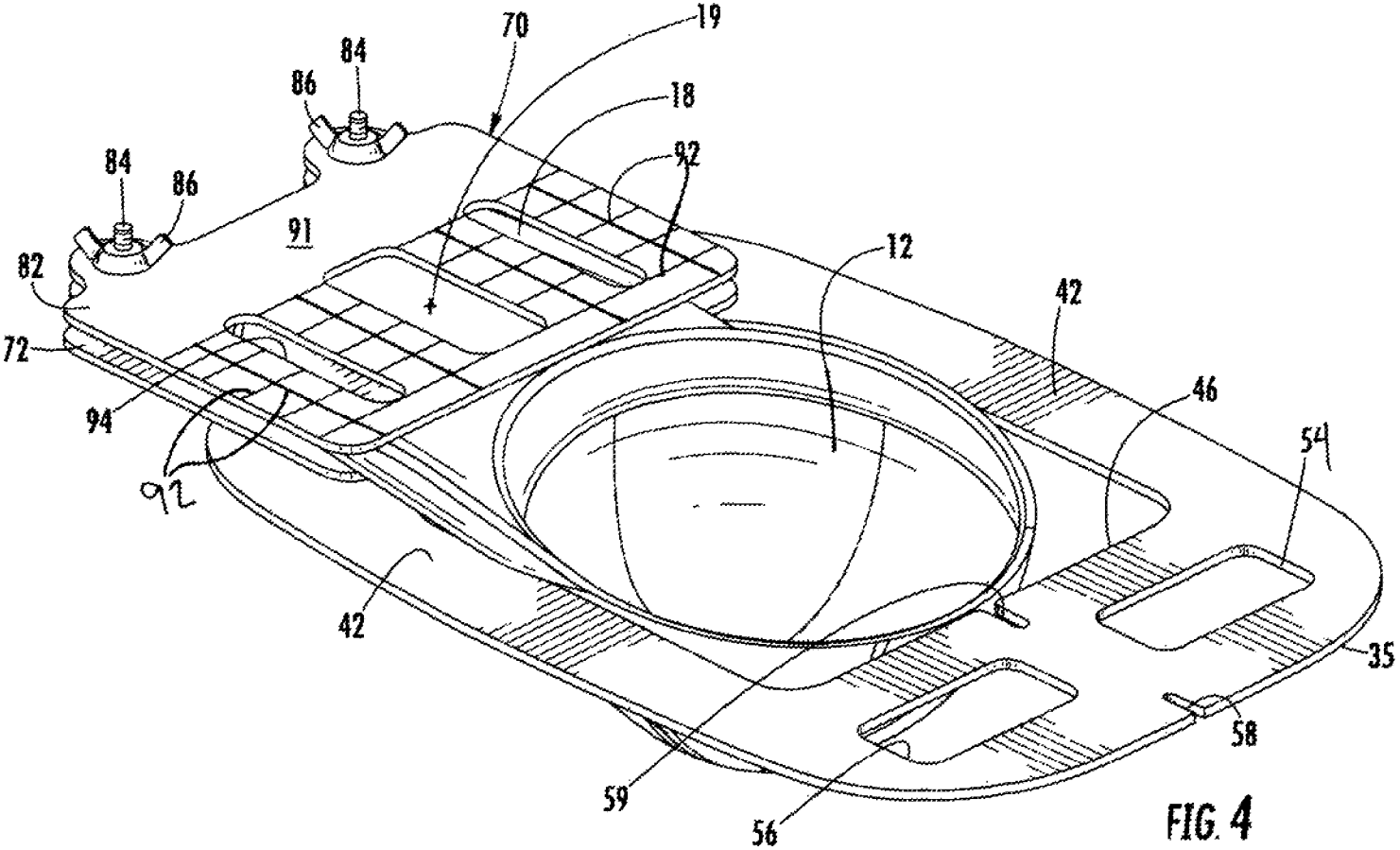
FIG. 4 shows a top perspective view of the embroidery frame shown in FIG. 1 having a billed-cap positioned therein.

Referring to the drawings wherein identical reference numerals denote the same elements throughout the various views, FIG. 1 depicts an embroidery frame 10. The embroidery frame 10 is configured to capture and retain a billed cap 12 (shown in FIG. 4) or hat such that the cap 12 can be positioned relative to an embroidery machine in a repeatable manner. The frame 10 is configured to be received by an embroidery machine such that a predetermined location 19 (shown in FIG. 4) on the cap 12 can be embroidered. Each of multiple substantially identical caps 12 can be received within frame 10 in succession such that a common feature of each of the caps 12 can be positioned relative to embroidery machine in the same way. As a result, an embroidery design can be placed on multiple caps 12 such that the design is in substantially the same place on each of the caps 12.

Figure 5:
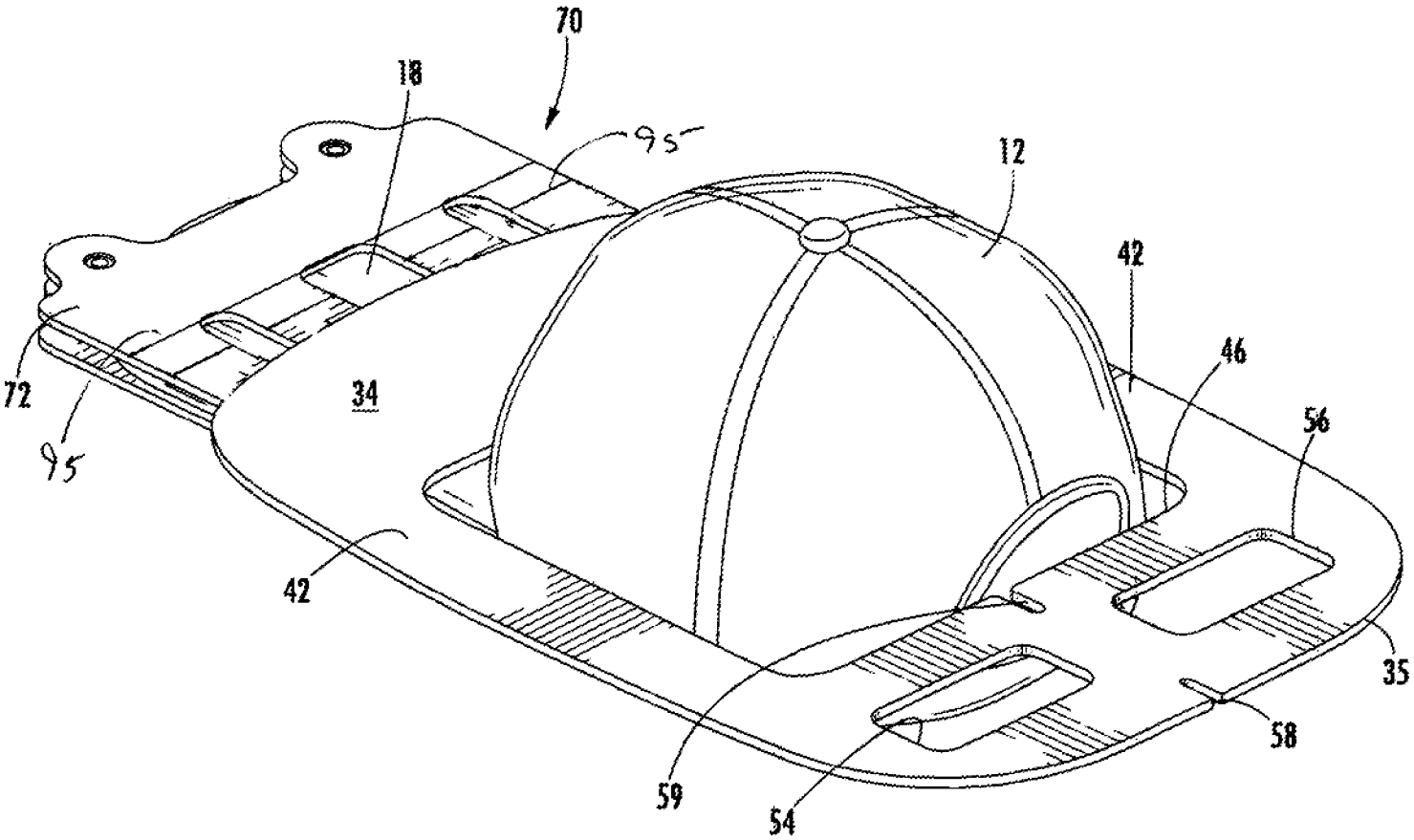
FIG. 5 shows a bottom perspective view of the embroidery frame retaining a cap as shown in FIG. 4.
Figure 6:
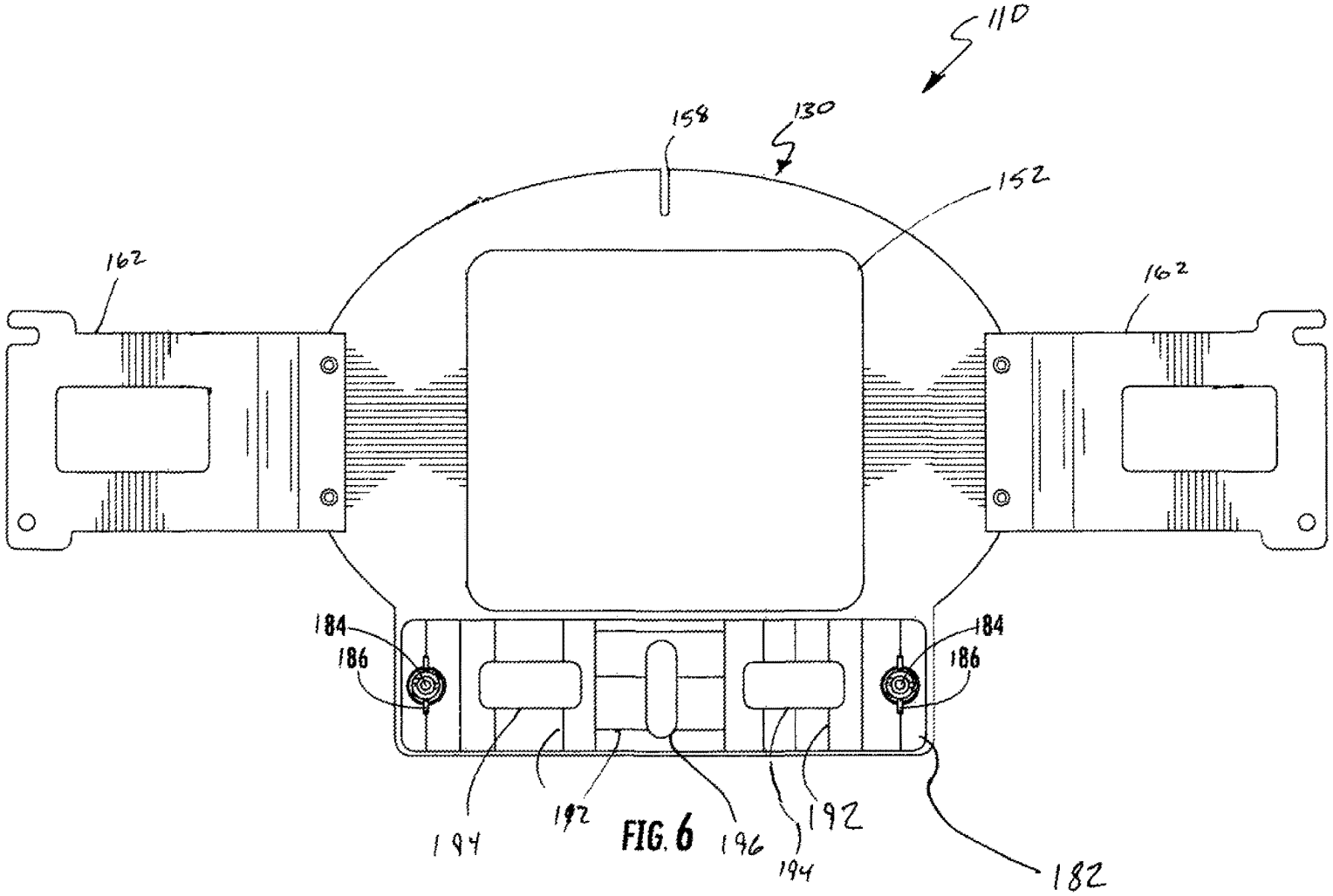
FIG. 6 shows a top plan view of an embroidery frame according to another embodiment of the present invention.
Figure 7:
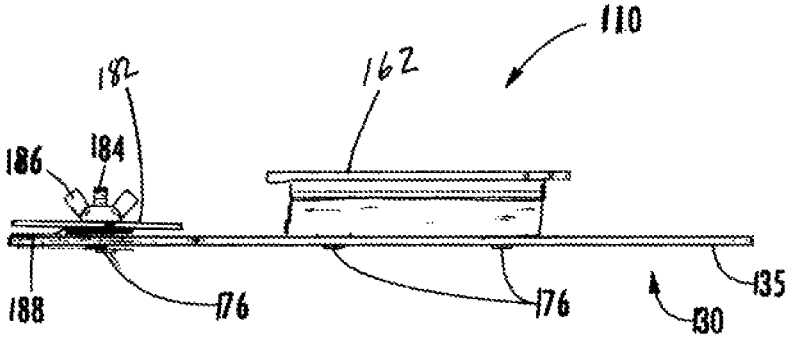
FIG. 7 shows a side view of the embroidery frame shown in FIG. 6.

Referring to FIG. 1, in accordance with an embodiment of the invention, the frame 10 includes a base 30. The base 30 is generally planar and defines an upper surface 32, is lower surface 34 (as shown in FIG. 5) and an outer perimeter 35. The lower surface 32 is configured to be retained on an embroidery machine by a sticky substrate as is generally known. The base 30 includes a first end 36 and a second end 38. The first end 36 and the second end 38 are connected by a pair of arms 42. The first end 36, the second end 38, and the arms 42 each has an interior edge with reference numbers 45, 46, 47, and 48 respectively. Together the edges 45, 46, 47, and 48 define a cap opening 52.

Continuing to refer to FIG. 1, a first side opening 54 and a second side opening 56 are defined in the second end 38 of the base 30. The first side opening 54 and the second side opening 56 are positioned generally opposite each other. An outer slot 58 extends from the outer perimeter 35 into the second end 36 of the base 30. An inner slot 59 extends from the cap opening 52 toward the outer slot 58. Together the outer slot 58 in the inner slot 59 define a centerline of the base 30. It should be appreciated that in sonic embodiments the outer slot 58 and the inner slot 59 can be arranged differently. In this regard the outer slot 58 in the inner slot 59 can be offset from each other such that they do not define a line. Alternatively, a line that they define can be spaced-away from the center of the base 30. The outer slot 58 and the inner slot 59 define a visible indicator is an alignment feature for use in aligning the cap 12 relative to the centerline of the frame 10.

The outer perimeter 35 of the base 30 is configured to receive a hoop that is configured to be received within an embroidery machine. The hoop is configured to receive the frame 10 in a predetermined manner such that when the hoop is positioned within an embroidery machine, the frame 10 is positioned relative to the embroidery machine in a predetermined and repeatable way.

Figure 3:
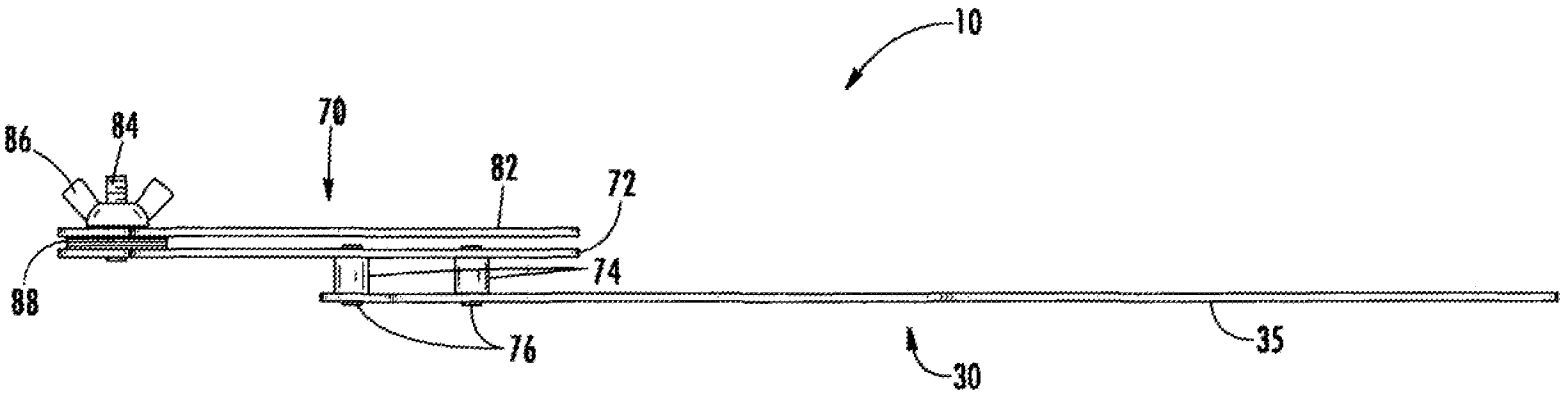
FIG. 3 shows a side view of the embroidery frame shown in FIG. 1.

A bill retention clip 70 is attached to the first end 36 of the base 30. The retention clip 70 includes a removably attached clamp plate 82 that is spaced-apart from the upper surface 34 of the base 30. A second plate 72 is spaced-away from the clamp plate 82 such that the second plate 72 is positioned between the clamp plate 82 and the base 30. Referring now to FIG. 3, generally cylindrical spacers 74 are positioned between the second plate 72 and the base 30. Threaded screws 76 extend through the second plate 72 and engage the base 30 such that the second plate 72 is retained with spaced-apart relation with the base 30.

According to the illustrated embodiment, a pair of threaded rods 84 extend from the second plate 72 through the clamp plate 82. The rods 84 are configured to receive a pair of wingnuts 86. A spacer 88 is positioned between the second plate 72 and the clamp plate 82. Thus the clamp plate 82 is retained by the wingnuts 86 and the rods 84 and separated from the second plate 72 by the spacer 88. The rods 84 pass through the spacer 88 which is positioned between the second plate 72 and the clamp plate 82. It should be appreciated that other means of connection can be present in other embodiments can be used to attach the clamp plate 82 to the second plate 72.

Referring now to FIG. 3, the clamp plate 82 defines a surface 91. Markings or multiple lines 92 are defined on the surface 91. The lines 92 operable as indicia and can be contiguous as shown or indicated by various symbols geometric shapes. It should be appreciated that the lines 92 can be visible is depicted in the illustrated, embodiment or can be configured to be detected by touch. Lines 92 are shown as parallel lines. In other embodiments lines 92 can cross, embody various geometric shapes such as curves or zigzags, or be otherwise defined.

Referring now to FIGS. 1 and 5, two outside openings 94 and an inside opening 96 are windows defined in the clamp plate 82. In the illustrated embodiment, the outside openings 94 and the inside opening 96 all have sides that are substantially perpendicular to the lines 92. In the illustrated embodiment, the outside openings 94 and the inside opening 96 are defined through the clamp plate 82 of the retention clip 70 such that a bill 18 of the cap 12 positioned therebetween is visible. It should be appreciated that the second plate can be configured in another way to allow for visibility of the bill of the cap. For example the second plate can include transparent windows.

Markings 92 are provided, on the clamp plate 82. The markings 92 are configured such that a predetermined location on the cap 12 can be positioned consistently relative to the clamp plate 82 and, as a result, the base 30 and an embroidery machine with which the base 30 is engaged. Two sets of markings 92 are provided in the illustrated embodiment. A first set of parallel lines is provided that can be configured in any position relative to the edges of the retention clip and a second set of parallel lines is defined such that they are perpendicular to the first set of lines. It should be appreciated that edges of the openings can also be utilized for alignment. A feature of the cap that is consistently located on different caps can be used as a reference point. The feature can be a marking made with a pen or other device or stitching or color change on the cap and/or brim of the cap.

A plurality of markings 95 are provided on the lower surface 32. Markings 95 are similar to the markings 92 in that the markings 95 are configured to be used to align the cap 12 such that it is positioned at a predetermined location or depth relative to the frame 10. As used herein, the term depth refers to the distance that a cap 12 extends away from the base 30 of the frame 10. When multiple caps 12 are positioned at the same depth, embroidered designs can be placed on those caps in substantially identical positions.

According to a second embodiment of the present invention, a frame 110 for use with multineedle embroidery machines is provided. Frame 110 is substantially similar to frame 10 described above except that frame 110 is not configured to be received within a hoop. Instead, frame 110 has arms 162 attached to the base 130 such that frame 110 can be attached to a multineedle embroidery machine. The arms are configured as mechanical alignment features.

Frame 110 does not include a retention clip that is spaced apart from the base as does frame 10. Instead, frame 110 includes a clamp plate 182 that is configured to retain a bill of a cap 112 between the clamp plate 182 and the base 130. The clamp plate 182 of frame 110 is configured substantially the same as the clamp plate 82 of Frame 10 in that alignment slots 158 and markings 192 are provided. In this regard markings 192 are formed on the surface of the clamp plate 182. Markings 195 (not shown) are formed on the underside of the Frame 110.

The present invention can be better understood by description of the operation thereof in a first step, the frame 10 is provided. A cap 12 is positioned such that the bill 18 is between the second plate 72 and a clamp plate 82 of the retention clip 70. The bill 18 is maneuvered such that a mark 19 thereon is visible. The location of the mark 19 relative to the marks 94 is then noted and compared to a desired location. In addition the cap 12 is maneuvered such that at least a predetermined visible location 21 on the cap away from the bill 18 is aligned with at least one of the inner slot 58 and the outer slot 59. When the mark 19 is in the desired location relative to the marks 94, and the location 21 is properly aligned with the inner slots 58 and outer slots 59, then the wingnuts 86 are tightened to retain the cap 12 in the desired position The frame 10 is then engaged with a hoop such that the cap 12 is oriented in a predetermined direction. Then the hoop is engaged with an embroidery machine. The embroidery process is begun and the embroidery machine is operated such that the embroidery design is applied to the cap 12. In this regard the embroidery design is applied to the cap 12 in a position relative to the bill 18 that can be repeated in subsequent embroidery processes.

In another step, the markings 95 on the lower side 32 of the base 30 can be used to align the bill 18 of the cap 12 with the frame 10. In this manner, a predetermined location on the cap 12 can be positioned at a predetermined depth relative to base 30. When multiple caps 12 are positioned in this manner in associated frames 10, multiple designs can be embroidered on caps in repeatable positions.

While the present invention has been illustrated and described with reference to preferred embodiments thereof, it will be apparent to those skilled in the art that modifications can be made and the Invention can be practiced in other environments without departing from the spirit and scope of the invention, set forth in the accompanying claims.

What is claimed is:

1. An embroidery frame for a garment that is configured to retain the garment in a repeatable position relative to an embroidery machine, the embroidery frame comprising:

a base;

a clamp plate spaced-away from the base such that a garment can be retained between the clamp plate and the base;

markings defined by the plate;

a second plate which together with the clamp plate, defines a retaining clip that is configured to capture a portion of a garment therebetween, and the retaining clip is spaced-apart from the base; and wherein the base and the clamp plate are dimensioned such that the markings are in a predetermined location relative to the base.

2. The embroidery frame according to claim 1, comprising:

a window defined in the clamp plate positioned such that the relative position of the markings and a predetermined location on a portion of the garment can be determined.

3. The embroidery frame according to claim 1 wherein the clamp plate is positioned on an upper side of the base and the base has an opposing lower side on which a second set of markings are defined that are configured for aligning the cap with the frame.

4. The embroidery frame according to claim 1 wherein an alignment feature is defined on the base on an end that is spaced away from the clamp plate.

5. The embroidery frame according to claim 4 wherein the alignment feature includes a notch.

6. The embroidery frame to claim 5 wherein the alignment feature includes an opposing pair of notches.

7. The embroidery frame according to claim 6 wherein the alignment feature is positioned along a centerline of the base.

8. The embroidery frame according to claim 1 wherein the clamp plate and the base are configured to retain a bill of a cap therebetween.

9. The embroidery frame according to claim 2, wherein the clamp plate in the second plate are configured to retain a bill of a cap therebetween.

10. A method for positioning a garment in a predetermined location relative to an embroidery frame, the method comprising the steps of:

positioning a portion of the garment within a retaining clip that is spaced away from a base;

aligning a location on the garment with markings defined by the retaining clip and the base; and capturing the garment in the retaining clip.

11. The method according to claim 10, further comprising the step of:

viewing the garment through a window defined in the retaining clip.

12. The method according to claim 11, further comprising the step of:

viewing markings defined on the clamp plate; and viewing markings defined on a lower side of a base of the frame that opposes the clamp plate.

13. An embroidery frame for a cap that has a bill, the embroidery frame comprising:

a base;

a retaining clip that includes a clamp plate and a second plate and is attached to the base such that it is spaced-away from the base:

markings defined by the retaining clip and by the base such that they are in a predetermined location; and wherein the retaining clip and the base are dimensioned such that the markings are in a predetermined location relative to an outer perimeter of the base.

14. The embroidery frame according to claim 13, comprising:

a window defined in the retaining clip that is positioned such that the relative position of the markings and a predetermined location on a portion of the garment can be determined.

15. The embroidery frame according to claim 14 comprising:

an alignment feature defined on the base and the markings are positioned in a predetermined location relative to the alignment feature.

16. The embroidery frame according to claim 15 wherein the alignment feature is a visible indicator.

17. The embroidery frame according to claim 16 wherein the visible indicator includes a notch.

* * * * *